US011109719B2

(12) United States Patent
Dong

(10) Patent No.: US 11,109,719 B2
(45) Date of Patent: Sep. 7, 2021

(54) OUTDOOR SHOWER DEVICE

(71) Applicant: XIAMEN KINGQUEEN INDUSTRIAL CO., LTD., Fujian (CN)

(72) Inventor: Jinfei Dong, Xiamen (CN)

(73) Assignee: XIAMEN KINGQUEEN INDUSTRIAL CO., LTD., Fujian (CN)

( * ) Notice: Subject to any disclaimer, the term of this patent is extended or adjusted under 35 U.S.C. 154(b) by 29 days.

(21) Appl. No.: 16/693,377

(22) Filed: Nov. 25, 2019

(65) Prior Publication Data

US 2020/0170454 A1 Jun. 4, 2020

(30) Foreign Application Priority Data

Nov. 30, 2018 (CN) ..... 201811451108.7

(51) Int. Cl.
*A47K 3/28* (2006.01)
*F24H 1/00* (2006.01)

(52) U.S. Cl.
CPC ..... *A47K 3/288* (2013.01); *F24H 1/0072* (2013.01)

(58) Field of Classification Search
CPC ..... A47K 3/288; F24H 1/0072
USPC ..... 4/603
See application file for complete search history.

(56) References Cited

U.S. PATENT DOCUMENTS 3,760,431 A * 9/1973 Schwibner ..... A47K 3/288 4/616
6,295,663 B1 * 10/2001 Haller ..... F24S 10/501 4/603
2013/0305449 A1 * 11/2013 Alios ..... B05B 1/24 4/616
2015/0289725 A1 * 10/2015 Shankar ..... A47K 3/288 4/616
2016/0346803 A1 * 12/2016 Crawford ..... B05B 9/04
2017/0282197 A1 * 10/2017 Garza ..... B05B 15/30
2020/0122187 A1 * 4/2020 DiStefano ..... B05C 11/1026

* cited by examiner

*Primary Examiner* — Huyen D Le
(74) *Attorney, Agent, or Firm* — Leong C. Lei

(57) ABSTRACT

An outdoor shower device includes a hollow water container, a gas bag disposed in the water container, and an inflating device configured to inflate the gas bag. The water container has a mouth, a water outlet pipe communicating with an inside of the water container, and a cover for tightly closing the mouth. An inside of the gas bag is in communication with the inflating device through a gas pip. When in use, the user pours water through the opening into the water container and inflates the gas bag by using the inflating device. As the gas bag is continuously inflated with gas, the water in the water container is discharged from the water outlet pipe for taking a comfortable shower.

17 Claims, 4 Drawing Sheets

OUTDOOR SHOWER DEVICE

BACKGROUND OF THE INVENTION

1. Field of the Invention

The present invention relates to a sanitary device, and more particularly to an outdoor shower device.

2. Description of the Prior Art

When a person takes a trip, works or swims outdoors and the body is dirty, he/she is in urgent need of taking a shower nearby. If he/she rushes back to his/her home, it will take a long time. Besides, if he/she uses a utensil for containing water to directly pour water onto the body, the large impact of the water will cause discomfort to the body.

Accordingly, the inventor of the present invention has devoted himself based on his many years of practical experiences to solve these problems.

SUMMARY OF THE INVENTION

The primary object of the present invention is to provide an outdoor shower device that has no stringent requirements on the site, is simple in structure and is easy to operate for the user to take a comfortable shower.

In order to achieve the above object, the present invention adopts the following technical solutions:

An outdoor shower device comprises a hollow water container, a gas bag disposed in the water container, and an inflating device configured to inflate the gas bag. The water container has a mouth, a water outlet pipe communicating with an inside of the water container, and a cover for tightly closing the mouth.

Preferably, the water container is a deformable bag.

Preferably, the deformable bag is made of a composite material of PVC, TPU and cloth.

Preferably, an inside of the gas bag is in communication with the inflating device through a gas pipe.

Preferably, the inflating device is an air pumping apparatus.

Preferably, the water container contains a substance that is able to generate heat in water and is harmless to a human body.

Preferably, the substance is quicklime.

Preferably, the gas bag after inflated has a maximum volume greater than or equal to that of the water container.

Preferably, the water outlet pipe is disposed at a bottom of the water container.

Preferably, the mouth is provided with an external thread portion extending upward, and an inner wall of the cover is provided with an internal thread portion to be screwed to the external thread portion.

In an embodiment of the present invention, the inflating device is a substance capable of generating a chemical reaction to generate a gas, and is disposed in the gas bag. The gas bag has a bag mouth and a sealing cover for tightly covering the bag mouth.

In an embodiment of the present invention, the inflating device is a substance capable of generating a chemical reaction to generate a gas and emit heat, and is disposed in the gas bag. The gas bag has a bag mouth and a sealing cover for tightly covering the bag mouth.

In an embodiment of the present invention, the inflating device is a container that contains a substance capable of generating a chemical reaction to generate a gas and emit heat. A top of the container is sealedly connected to the gas bag through a gas pipe.

In an embodiment of the present invention, the inflating device is a container that contains a substance that can react with water to emit heat, and the container is sealedly connected to the gas bag through a pipe.

Preferably, the container is made of metal.

Preferably, the container is placed in the water container.

When in use, the user pours water through the opening into the water container, and the gas bag is in a compressed state at this time, and then the opening is tightened covered with the cover. After that, the user inflates the gas bag by using the inflating device. As the gas bag is continuously inflated with gas, the water in the water container is discharged from the water outlet pipe. When the speed of inflation is high, the gas bag expands fast, the gas bag has a strong force on water, and the water flows out quickly. On the contrary, when the speed of inflation is slow, the gas bag expands slowly, the gas bag has a small force on water, and the water flows out slowly. The user can adjust the speed of inflation as needed to take a comfortable shower. The invention has a simple structure and is easy to operate. In terms of use, the invention has no strict requirements on the site.

DETAILED DESCRIPTION OF THE PREFERRED EMBODIMENTS

Embodiments of the present invention will now be described, by way of example only, with reference to the accompanying drawings.

Figure 1:
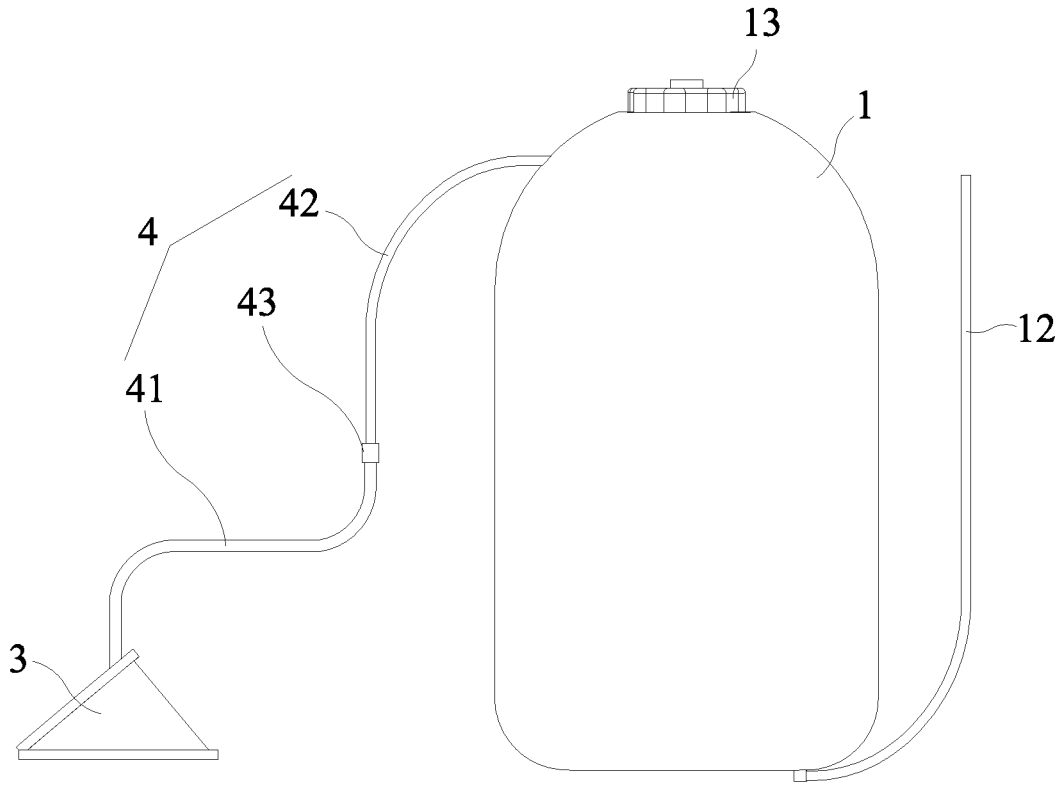
FIG. 1 is a front view in accordance with a first embodiment of the present invention.
Figure 2:
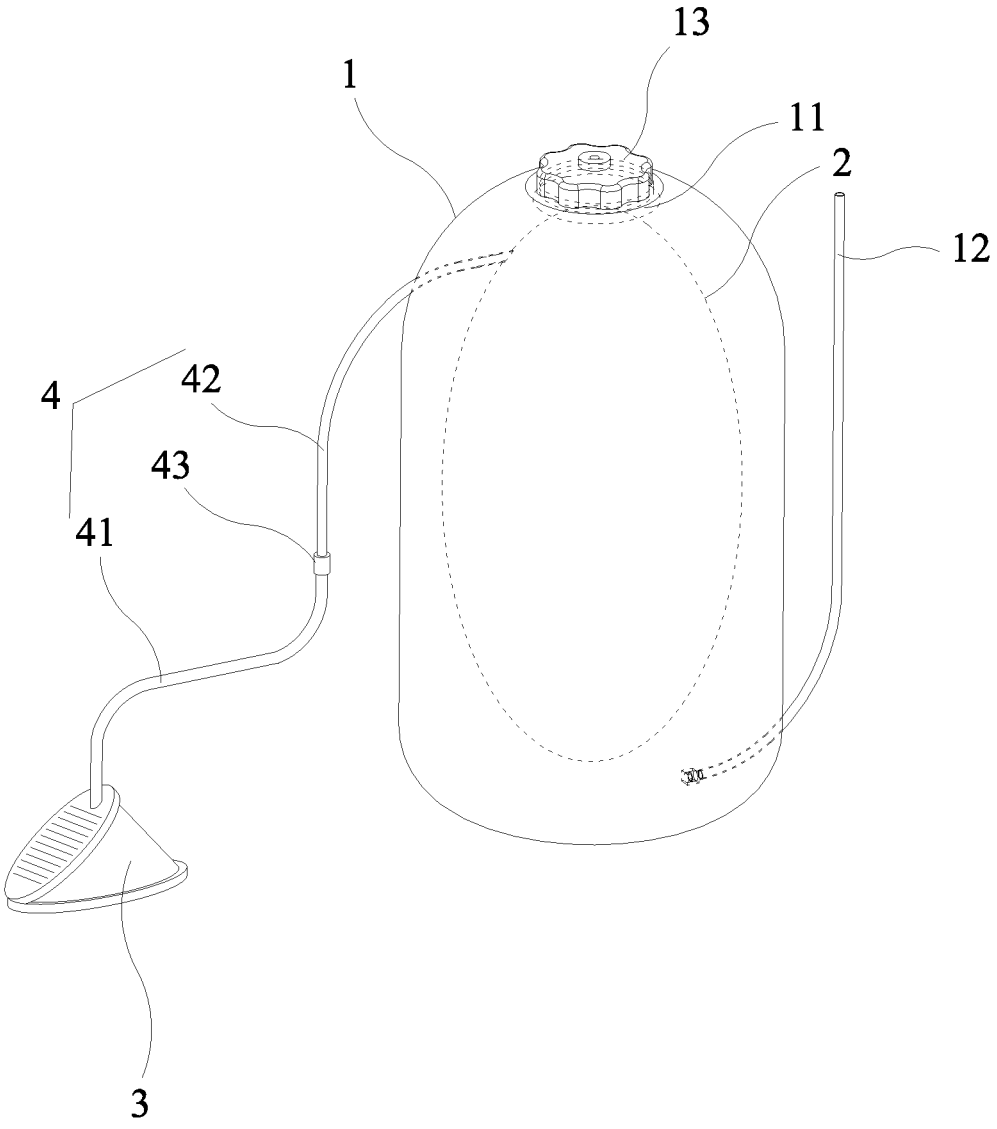
FIG. 2 is a perspective view in accordance with the first embodiment of the present invention.
Figure 3:
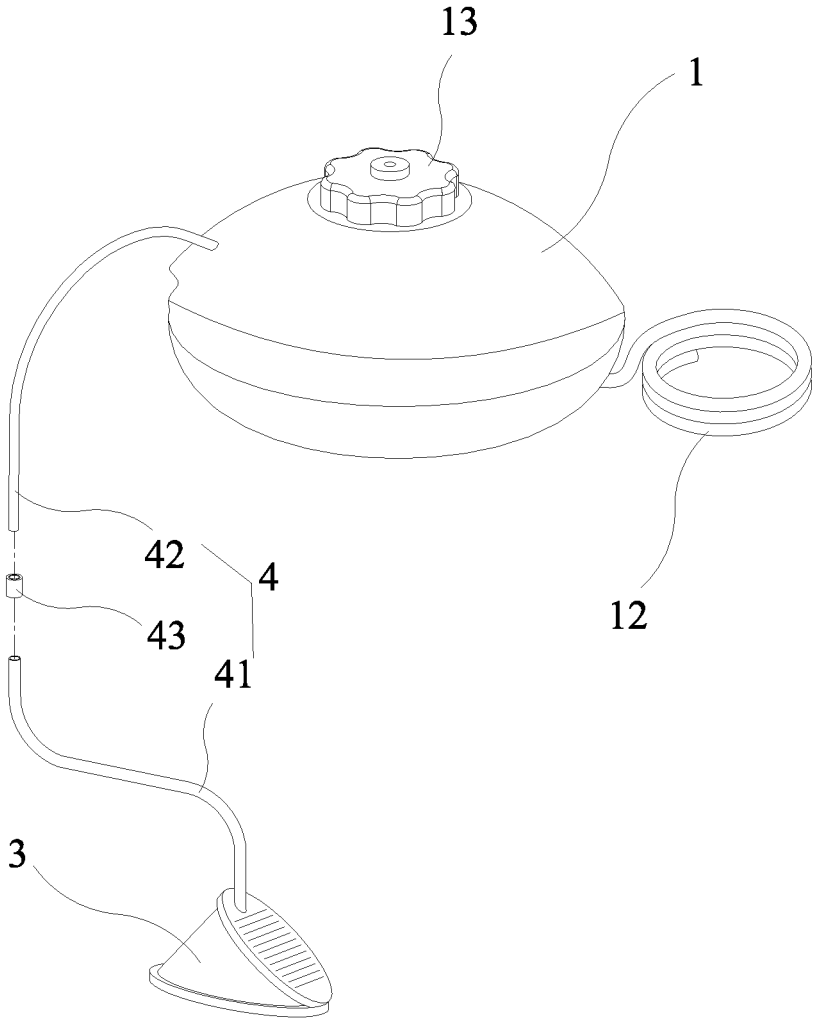
FIG. 3 is a schematic view in accordance with the first embodiment of the present invention after compressed.

As shown in FIG. 1 through FIG. 3, an outdoor shower device in accordance with a first embodiment of the present invention comprises a hollow water container 1, a gas bag 2 disposed in the water container 1, and an inflating device 3 configured to inflate the gas bag 2. The water container 1 has a mouth 11 at a top end of the water container 1, a water outlet pipe 12 communicating with the inside of the water container 1, and a cover 13 for tightly closing the mouth 11. The inside of the gas bag 2 is in communication with the inflating device 3 through a gas pipe 4. The water container 1 may be a barrel. In this embodiment, the water container 1 is a deformable bag. The deformable bag is made of a composite material of PVC, TPU and cloth. The water container 1 is selected from a deformable bag, so that when not in use, the water container 1 can be folded into a small size to be stored or carried.

In this embodiment, the inflating device 3 is a foot pump, which is convenient for inflation, but not limited thereto. The inflating device 3 may be other air pumping equipment, such as a manual air pump and an electric air pump. The surface of the foot pump is formed with a plurality of shallow grooves to increase the friction between the foot and the surface of the foot pump. The inflating device may be an automatic pump. The gas pipe 4 includes a first gas pipe 41 and a second gas pipe 42 that communicates with the first gas pipe 41 through a connecting member 43. The first gas pipe 41 and the second gas pipe 42 are tightly connected to two ends of the connecting member 43. When it is necessary to discharge the gas in the gas bag 2, the second gas pipe 42 can be removed from the connecting member 43, and the gas in the gas bag 2 can be expelled.

In order to heat the water contained in the water container 1, the water container 1 may contain a substance that is able to generate heat in water and is harmless to the human body. The substance may be quicklime, but other substances may be used, not limited thereto.

Furthermore, in order to fully discharge the water contained in the water container 1, the maximum volume of the gas bag 2 after inflated is greater than or equal to the maximum volume of the water container 1. For the water to be discharged easily, the water outlet pipe 12 is disposed at the bottom of the water container 1.

In this embodiment, the mouth 11 is provided with an external thread portion extending upward. The inner wall of the cover 13 is provided with an internal thread portion to be screwed to the external thread portion. Through the engagement of the external thread portion and the internal thread portion, the cover 13 tightly covers the mouth 11. In order to facilitate rotation of the cover 13 to screw the external thread portion with the internal thread portion, the outer wall of the cover 13 is formed with a plurality of protrusions that are evenly spaced from each other. The structure for the cover 13 to tightly close the mouth 11 is not limited thereto. Alternatively, the mouth may be provided with a cylindrical wall extending upward, and the cover is a rubber plug that is interference fit with the cylindrical wall. The top of the rubber plug may be formed with an annular surface that can be bent downward to be fitted to the cylindrical wall.

Figure 4:
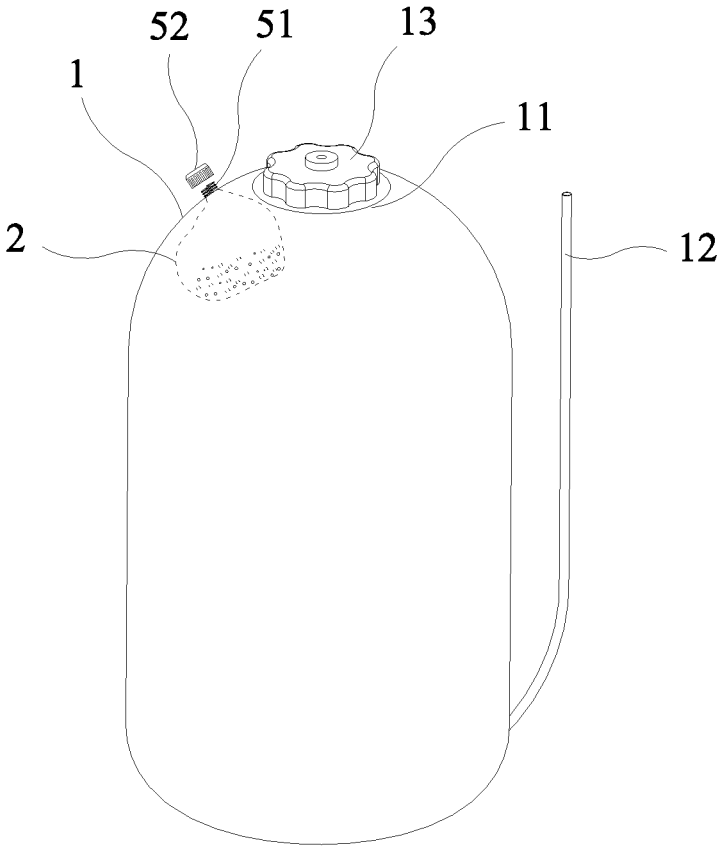
FIG. 4 is a perspective view in accordance with a second embodiment of the present invention.

FIG. 4 illustrates a second embodiment of the present invention, which is substantially similar to the first embodiment with the exceptions described hereinafter. The second embodiment doesn't have the inflating device and the gas pipe. The inflating device is a substance capable of generating a chemical reaction to generate a gas, such as a substance that can react with water to generate a gas, and is disposed in the gas bag 2. The gas bag 2 has a bag mouth 51 to communicate with the outside and a sealing cover 52 for tightly covering the bag mouth 51. If necessary, the sealing cover 52 is opened, water is introduced from the bag mouth 51, and the sealing cover 52 tightly covers the bag mouth 51, so that the inflating device continuously reacts with the water to generate a gas. When the amount of the introduced water and the amount of the inflating device are different, and the amount and rate of the gas generated are different, so that the inflation of the gas bag 2 can be controlled. The inflating device may be a substance capable of generating a chemical reaction to generate a gas and emit heat, and is disposed in the gas bag 2. The gas bag 2 has a bag mouth 51 to communicate with the outside and a sealing cover 52 for tightly covering the bag mouth 51. The gas bag 2 can emit the heat generated by the chemical reaction into the water container 1. The inflating device may be a container that contains a substance capable of generating a chemical reaction to generate a gas and emit heat. The top of the container is sealedly connected to the gas bag 2 through a gas pipe. The container is made of metal. The material of the container may be selected from one of materials that do not react with substances that react chemically. In addition, the inflating device may be a container that contains a substance that can react with water to emit heat. The container is sealedly connected to the gas bag through a pipe. The container is made of metal. The container is placed in the water container. The material that can react with water to emit heat may use quicklime (CaO). With $CaO+H_2O=Ca(OH)_2$, heat is generated during the chemical reaction, and the heat expands the gas and heats the water in the water container 1, so as to inflate the gas bag 2.

In summary, when in use, the user pours water through the opening 11 into the water container 1, and the gas bag 2 is in a compressed state at this time, and then the opening 11 is tightened covered with the cover 13. After that, the user inflates the gas bag 2 by using the inflating device 3. As the gas bag 2 is continuously inflated with gas, the water in the water container 1 is discharged from the water outlet pipe 12. When the speed of inflation is high, the gas bag 2 expands fast, the gas bag 2 has a strong force on water, and the water flows out quickly. On the contrary, when the speed of inflation is slow, the gas bag 2 expands slowly, the gas bag 2 has a small force on water, and the water flows out slowly. The user can adjust the speed of inflation as needed to take a comfortable shower. The invention has a simple structure and is easy to operate. In terms of use, the invention has no strict requirements on the site.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An outdoor shower device, comprising: a hollow water container, a gas bag disposed in the water container, and an inflating device configured to inflate the gas bag; the water container having a mouth, a water outlet pipe communicating with an inside of the water container, and a cover for tightly closing the mouth.

2. The outdoor shower device as claimed in claim 1, wherein the water container is a deformable bag.

3. The outdoor shower device as claimed in claim 2, wherein the deformable bag is made of a composite material of PVC, TPU and cloth.

4. The outdoor shower device as claimed in claim 1, wherein an inside of the gas bag is in communication with the inflating device through a gas pipe.

5. The outdoor shower device as claimed in claim 4, wherein the inflating device is an air pumping apparatus.

6. The outdoor shower device as claimed in claim 1, wherein the water container contains a substance that is able to generate heat in water and is harmless to a human body.

7. The outdoor shower device as claimed in claim 6, wherein the substance is quicklime.

8. The outdoor shower device as claimed in claim 1, wherein the gas bag after inflated has a maximum volume greater than or equal to that of the water container.

9. The outdoor shower device as claimed in claim 1, wherein the water outlet pipe is disposed at a bottom of the water container.

10. The outdoor shower device as claimed in claim 1, wherein the mouth is provided with an external thread portion extending upward, and an inner wall of the cover is provided with an internal thread portion to be screwed to the external thread portion.

11. The outdoor shower device as claimed in claim 1, wherein the inflating device is a substance capable of generating a chemical reaction to generate a gas, and is disposed in the gas bag; the gas bag has a bag mouth and a sealing cover for tightly covering the bag mouth.

12. The outdoor shower device as claimed in claim 1, wherein the inflating device is a substance capable of generating a chemical reaction to generate a gas and emit heat, and is disposed in the gas bag; the gas bag has a bag mouth and a sealing cover for tightly covering the bag mouth.

13. The outdoor shower device as claimed in claim 1, wherein the inflating device is a container that contains a substance capable of generating a chemical reaction to generate a gas and emit heat, and a top of the container is sealedly connected to the gas bag through a gas pipe.

14. The outdoor shower device as claimed in claim 13, wherein the container is made of metal.

15. The outdoor shower device as claimed in claim 1, wherein the inflating device is a container that contains a substance that can react with water to emit heat, and the container is sealedly connected to the gas bag through a pipe.

16. The outdoor shower device as claimed in claim 15, wherein the container is made of metal.

17. The outdoor shower device as claimed in claim 15, wherein the container is placed in the water container.

* * * * *